US008547309B2

(12) United States Patent
Byun

(10) Patent No.: US 8,547,309 B2
(45) Date of Patent: Oct. 1, 2013

(54) ORGANIC LIGHT EMITTING DIODE DISPLAY AND DRIVING METHOD

(75) Inventor: Seungchan Byun, Incheon (KR)

(73) Assignee: LG Display Co., Ltd., Seoul (KR)

( * ) Notice: Subject to any disclaimer, the term of this patent is extended or adjusted under 35 U.S.C. 154(b) by 585 days.

(21) Appl. No.: 12/591,898

(22) Filed: Dec. 3, 2009

(65) Prior Publication Data

US 2010/0277513 A1 Nov. 4, 2010

(30) Foreign Application Priority Data

Apr. 29, 2009 (KR) ..... 10-2009-0037645

(51) Int. Cl.
*G09G 3/30* (2006.01)

(52) U.S. Cl.
USPC ..... 345/77; 345/690; 345/211; 345/212; 315/169.3

(58) Field of Classification Search
USPC ..... 345/690–697, 79, 82, 213, 76–77; 315/169.3
See application file for complete search history.

(56) References Cited

U.S. PATENT DOCUMENTS 6,593,934 B1 * 7/2003 Yang et al. ..... 345/590
6,806,853 B2 * 10/2004 Park et al. ..... 345/82
7,079,091 B2 * 7/2006 Kondakov et al. ..... 345/76
7,133,010 B2 * 11/2006 Kim et al. ..... 345/76
7,212,187 B2 * 5/2007 Park et al ..... 345/100
2002/0105279 A1 * 8/2002 Kimura ..... 315/169.3
2002/0195968 A1 * 12/2002 Sanford et al. ..... 315/169.3
2003/0201955 A1 * 10/2003 Song et al. ..... 345/76
2004/0150592 A1 * 8/2004 Mizukoshi et al. ..... 345/76
2004/0201582 A1 * 10/2004 Mizukoshi et al. ..... 345/211
2005/0052350 A1 * 3/2005 Mizukoshi et al. ..... 345/55
2006/0027822 A1 * 2/2006 Choi et al. ..... 257/94
2007/0052632 A1 * 3/2007 Wu et al. ..... 345/76
2007/0080911 A1 * 4/2007 Liu et al. ..... 345/82
2007/0146252 A1 * 6/2007 Miller et al. ..... 345/77
2007/0273701 A1 * 11/2007 Mizukoshi et al. ..... 345/531
2009/0179832 A1 * 7/2009 Kohno et al. ..... 345/76
2009/0213048 A1 * 8/2009 Park et al. ..... 345/77
2010/0182299 A1 * 7/2010 Hyoudou et al. ..... 345/211

* cited by examiner

*Primary Examiner* — Alexander Eisen
*Assistant Examiner* — Sanjiv D Patel
(74) *Attorney, Agent, or Firm* — McKenna Long & Aldridge, LLP

(57) ABSTRACT

An OLED display including a display panel having a plurality of R, G, and B pixels formed and at least one of a high-potential and low-potential driving voltage supply line disposed; a data driving circuit; a gamma reference voltage generating circuit for generating gamma reference voltages for R, G, and B by dividing voltages of high-potential gamma power sources; a current estimating circuit for generating digital estimated current values for R, G, and B; a current sensing circuit for generating digital sensing current values for R, G, and B; and a gamma power source control circuit for controlling the high-potential gamma power sources by comparing the digital estimated current values for R, G, and B with the digital sensing current values for R, G, and B so that driving currents corresponding to the respective digital estimated current values flow in the respective R, G, and B pixels.

10 Claims, 12 Drawing Sheets

(A) (B)

B : Black Gray
W : White Gray

ORGANIC LIGHT EMITTING DIODE DISPLAY AND DRIVING METHOD

This application claims the benefit of Korean Patent Application No. 10-2009-0037645 filed on Apr. 29, 2009, which is incorporated herein by reference for all purposes as if fully set forth herein.

BACKGROUND OF THE INVENTION

1. Field of the Invention

This document relates to an organic light emitting diode display, and more particularly, to an organic light emitting diode display, which can prevent luminance change and color distortion that are caused by an image display pattern or an outdoor environmental condition.

2. Discussion of the Related Art

Recently, there has been developed various flat panel display that can reduce their weight and size which were disadvantages of a cathode ray tube. The flat panel display includes a liquid crystal display (hereinafter, referred to as "LCD"), a field emission display FED, a plasma display panel (hereinafter, referred to as "PDP"), an electroluminescence EL, and the like.

The PDP among them is simple in its structure and fabrication process, thus the PDP is light, thin, short and small and has been paid attention to as a display which is most advantageous in being made large-sized, but there is a big disadvantage in that the luminous efficiency and luminance thereof are low and the power consumption thereof is high. A TFT LCD to which a thin film transistor (hereinafter, referred to as "TFT") is applied as a switching device is one of the most widely used flat panel display, but has the problems of narrow viewing angle and low response speed because the TFT LCD is a non-light-emitting device. In comparison with this, the electroluminescence device is broadly classified into an inorganic light emitting diode display and an organic light emitting diode display in accordance with a material of a luminous layer thereof. Especially, the organic light emitting diode display uses a self-luminous device which emits light on its own, and has an advantage in that its response speed is fast and its luminous efficiency, luminance and viewing angle are high.

The organic light emitting diode display has an organic light emitting diode OLED, as in FIG. 1. The organic light emitting diode includes an anode electrode, a cathode electrode, and an organic compound layer HIL, HTL, EML, ETL, EIL formed between the two electrodes.

The organic compound layer includes a hole injection layer HIL, a hole transport layer HTL, an emission layer EML, an electron transport layer ETL and an electron injection layer EIL.

If drive voltages are applied to the anode electrode and the cathode electrode, holes within the hole injection layer HTL and electrons within the electron transport layer ETL respectively move to the emission layer EML to form excitons. And, as a result, the emission layer EML emits a visible ray.

The organic light emitting diode display includes a plurality of pixels each including an organic light emitting diode which are arranged in a matrix form. The pixels are selected by selectively turning on the TFT, which is an active element, with a scan pulse, and then digital video data is supplied to the selected pixels, thereby controlling the luminance of the pixels in accordance with the gray level of the digital video data. Each of the pixels includes a driving TFT, at least one switching TFT, a storage capacitor, and so on, and the luminance of the pixels is proportional to a driving current flowing in the organic light emitting diode OLED as in the following Equation 1.

$$Ioled = \frac{k}{2}(Vgs - Vth)^2 \quad \text{[Equation 1]}$$

Wherein 'Ioled' represents a driving current, 'k' represents a constant defined by mobility and a parasitic capacitance of the driving TFT, 'Vgs' represents a voltage between the gate and source of the driving TFT, and 'Vth' represents a threshold voltage of the driving TFT, respectively.

However, such an organic light emitting diode display has the problems that the luminance is different for each of R, G, and B pixels (PB) depending on an image display pattern or an outdoor environmental condition, and this leads to color distortion.

First, luminance change and color distortion caused by an image display pattern will be described below.

An organic light emitting diode display is driven according to a voltage driving type or a current driving type. Especially, an organic light emitting diode display of a voltage driving type exhibits an IR drop due to a driving current Ioled flowing in the organic light emitting diode OLED and a resistance Ra of power supply lines 1 and 2 as shown in FIG. 2. The IR drop changes the voltage between the gate and source of the driving TFT by raising/dropping a potential of the source electrode of the driving TFT and hence. In other words, the IR drop reduces the voltage Vgs between the gate and source of the driving TFT DT by raising (VSS rise) the potential of the source electrode S of the driving TFT DT by ΔV on a panel using an a-Si (amorphous silicon) backplane as shown in FIGS. 3*a* and 3*b*, and reduces the voltage Vgs between the gate and source of the driving TFT DT by dropping the potential of the source electrode S of the driving TFT DT by ΔV on a panel using an LTPS (low temperature polysilicon) backplane as shown in FIG. 4. As a result, as can be seen from the above Equation 1, display luminance becomes lower than a desired luminance level according to the reduction of the voltage Vgs between the gate and source.

Due to the IR drop, a luminance difference between a desired luminance level and an actual luminance level is varied according to an image display pattern. That is, the degree of luminance difference becomes larger in a display pattern shown in (B) of FIG. 5 having a relatively large light emitting area than in a display pattern shown in (A) of FIG. 5 having a relatively small light emitting area. This is because, although the resistance Ra of the power supply lines 1 and 2 formed on the panel is constant regardless of the image display pattern, the overall amount of the driving current flowing in the panel increases in proportion to the light emitting area and accordingly the amount of reduction of the voltage Vgs between the gate and source of the driving TFT caused by the IR drop increases. A more significant issue is that when the voltage Vgs between the gate and source of the driving TFT is changed depending on the image display pattern due to the IR drop, color coordinates are distorted. Since the light emitting efficiencies of the R, G, and B organic light emitting diodes are different from each other because of the characteristics of the material, the amount of a driving current for realizing the same gray level is different for each of the R, G, and B pixels. Therefore, each time the image display pattern is changed, the amount of IR drop and the amount of change in the voltage Vgs between the gate and source of the driving TFT becomes different for each of the R, G, and B pixels. As a result, as shown in FIG. 6, change in luminance according to a light emitting area is varied for each of the R, G, and B pixels, and hence color coordinates are distorted, thus causing color distortion.

Next, luminance change and color distortion caused by an outdoor environment condition will be described below.

As shown in FIGS. 3*a* and 3*b*, on a panel using an a-Si (amorphous silicon) backplane, owing to device characteristics of the driving TFT DT, the mobility of the driving TFT DT is varied by the effect of an outside temperature or a photocurrent flows in the driving TFT DT by the effect of outside illuminance. In case of FIG. 3*a*, the driving TFTs DT are designed to have the same characteristics, and therefore luminance difference among the R, G, and B pixels and color distortion that are caused by the variation of mobility and the generation of photocurrent are not that noticeable. However, in case of FIG. 3*b*, the driving TFTs DT of the R, G, and B pixels are designed to have different characteristics from one another in order to compensate for differences in the characteristics of the R, G, and B organic light emitting diodes with different threshold voltages Vo, and therefore luminance difference among the R, G, and B pixels and color distortion that are caused by the variation of mobility and the generation of photocurrent are very noticeable.

SUMMARY OF THE INVENTION

An aspect of this document is to provide an organic light emitting diode display, which can prevent color distortion by realizing a constant luminance (desired luminance) regardless of an image display pattern or an outdoor environment condition, and a driving method thereof.

To achieve the above aspect, there is provided an organic light emitting diode display according to an exemplary embodiment of the present invention, including: a display panel where a plurality of R, G, and B pixels are formed at crossing points of a plurality of data lines and a plurality of gate lines and at least one of a high-potential driving voltage supply line and a low-potential driving voltage supply line is disposed divided for R, G, and B; a data driving circuit for converting input RGB data into data voltages with reference to gamma reference voltages and then supplying the data voltages to the data lines; a gamma reference voltage generating circuit for generating the gamma reference voltages for R, G, and B by dividing voltages of high-potential gamma power sources; a current estimating circuit for generating digital estimated current values for R, G, and B in a corresponding frame by using the input RGB data for one frame; a current sensing circuit for generating digital sensing current values for R, G, and B in the corresponding frame by using driving currents for R, G, and B fed back from the divided driving voltage supply lines; and a gamma power source control circuit for controlling the high-potential gamma power sources for R, G, and B by comparing the digital estimated current values for R, G, and B with the digital sensing current values for R, G, and B so that driving currents corresponding to the respective digital estimated current values flow in the respective R, G, and B pixels.

The current estimating circuit includes: an R adder for accumulating corresponding R driving current values output upon each receipt of the R data and generating an R digital estimated current value in the corresponding frame; a G adder for accumulating corresponding G driving current values output upon each receipt of the G data and generating a G digital estimated current value in the corresponding frame; and a B adder for accumulating corresponding B driving current values output upon each receipt of the B data and generating a B digital estimated current value in the corresponding frame.

The current estimating circuit further includes: an R look-up table for storing a plurality of R driving current values determined beforehand corresponding to gray level values of the R data; a G look-up table for storing a plurality of G driving current values determined beforehand corresponding to gray level values of the G data; and a B look-up table for storing a plurality of B driving current values determined beforehand corresponding to gray level values of the B data.

The current sensing circuit includes: an R amplifier for converting a R driving current value flowing in a R sensing resistor in the corresponding frame into a voltage value and outputting the same; a G amplifier for converting a G driving current value flowing in a G sensing resistor in the corresponding frame into a voltage value and outputting the same; a B amplifier for converting a B driving current value flowing in a B sensing resistor in the corresponding frame into a voltage value and outputting the same; and an analog-to-digital converter for analog-to-digital converting the voltage values from the R, G, and B amplifiers and generating digital sensing current values for R, G, and B.

The organic light emitting diode display further includes a driving voltage supply circuit for supplying a high-potential driving voltage to the high-potential driving voltage supply line and a low-potential driving voltage to the low-potential driving voltage supply line, and the R, G, and B sensing resistors are formed in the high-potential driving voltage supply line between the driving voltage supply circuit and the display panel or in the low-potential driving voltage supply line between the driving voltage supply circuit and the display panel.

The organic light emitting diode display includes: an R comparator for comparing the R digital estimated current value with the R digital sensing value to generate a R digital luminance control value; a G comparator for comparing the G digital estimated current value with the G digital sensing value to generate a G digital luminance control value; a B comparator for comparing the B digital estimated current value with the B digital sensing value to generate a B digital luminance control value; and a digital-to-analog converter for digital-to-analog converting the R, G, and B digital luminance control values and outputting the analog values as high-potential gamma power sources for R, G, and B, respectively.

The R digital luminance control value is generated as a digital value which lowers the output level of the R high-potential gamma power source in case the R digital sensing current value is larger than the R digital estimated current value, or the R digital luminance control value is generated as a digital value which raises the output level of the R high-potential gamma power source in case the R digital sensing current value is smaller than the R digital estimated current value.

The G digital luminance control value is generated as a digital value which lowers the output level of the G high-potential gamma power source in case the G digital sensing current value is larger than the G digital estimated current value, or the G digital luminance control value is generated as a digital value which raises the output level of the G high-potential gamma power source in case the G digital sensing current value is smaller than the G digital estimated current value.

The B digital luminance control value is generated as a digital value which lowers the output level of the B high-potential gamma power source in case the B digital sensing current value is larger than the B digital estimated current value, or the B digital luminance control value is generated as a digital value which raises the output level of the B high-potential gamma power source in case the B digital sensing current value is smaller than the B digital estimated current value.

The organic light emitting diode display further includes: a gate driving circuit for supplying a scan pulse to the gate lines; and a timing controller for controlling operation timings of the data driving circuit and gate driving circuit, and the current estimating circuit is incorporated in the timing controller.

According to an exemplary embodiment of the present invention, there is provided a driving method of an organic light emitting diode display, including a display panel where a plurality of R, G, and B pixels are formed at crossing points of a plurality of data lines and a plurality of gate lines and at least one of a high-potential driving voltage supply line and a low-potential driving voltage supply line is disposed divided for R, G, and B, the method including: generating digital estimated current values for R, G, and B in a corresponding frame by using input RGB data for one frame; generating digital sensing current values for R, G, and B in the corresponding frame by using driving currents for R, G, and B fed back from the divided driving voltage supply lines; controlling the high-potential gamma power sources for R, G, and B by comparing the digital estimated current values for R, G, and B with the digital sensing current values for R, G, and B so that driving currents corresponding to the respective digital estimated current values flow in the respective R, G, and B pixels; dividing the high-potential gamma power sources for R, G, and B to generate gamma reference voltages for R, G, and B; and converting the input RGB data into data voltages with reference to gamma reference voltages and then supplying the data voltages to the data lines.

BRIEF DESCRIPTION OF THE DRAWINGS

The accompanying drawings, which are included to provide a further understanding of the invention and are incorporated on and constitute a part of this specification illustrate embodiments of the invention and together with the description serve to explain the principles of the invention.

In the drawings.

DETAILED DESCRIPTION OF THE PREFERRED EMBODIMENTS

Hereinafter, an implementation of this document will be described in detail with reference to FIGS. 7 to 12.

Figure 7:
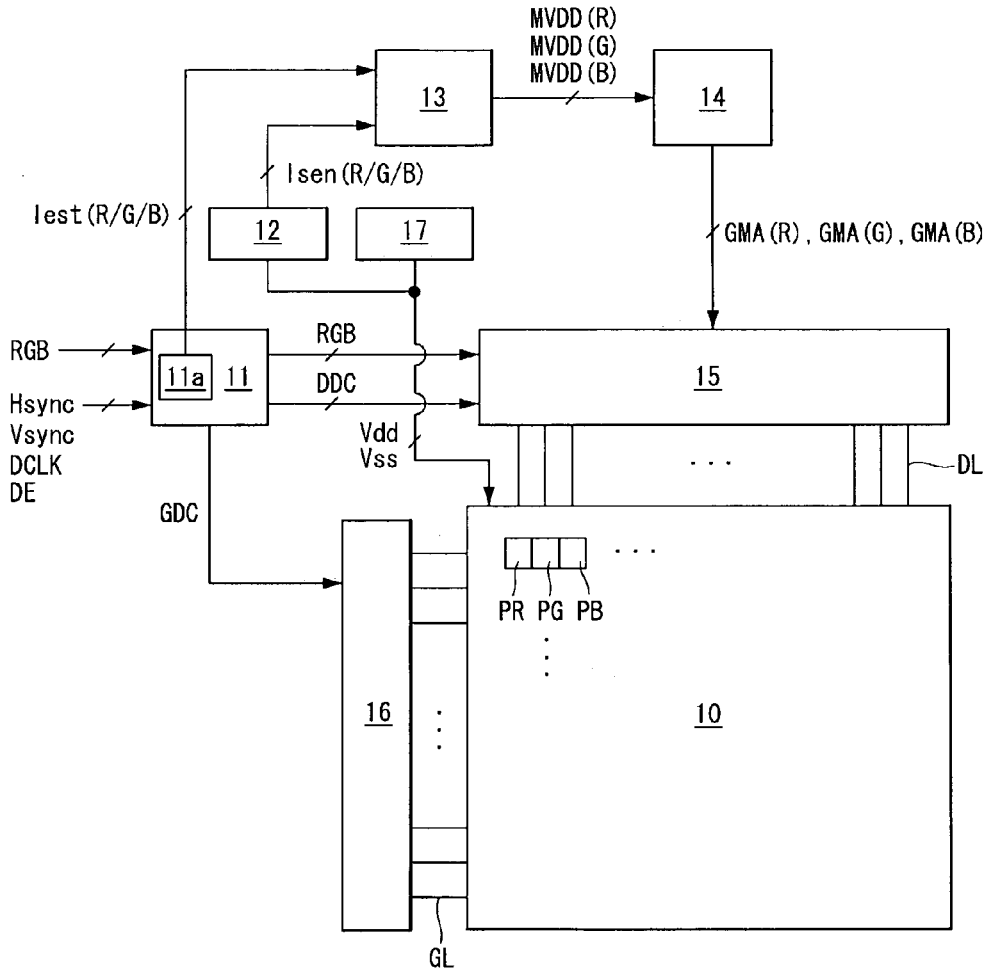
FIG. 7 is a block diagram showing an organic light emitting diode display according to an exemplary embodiment of the present invention.

FIG. 7 is a block diagram showing an organic light emitting diode display according to an exemplary embodiment of the present invention.

Referring to FIG. 7, the organic light emitting diode display according to the exemplary embodiment of the present invention includes a display panel 10, a timing controller 11, a current estimating circuit 11*a*, a current sensing circuit 12, a gamma power source control circuit 13, a gamma reference voltage generating circuit 14, a data driving circuit 15, a gate driving circuit 16, and a driving voltage supply circuit 17.

The display panel 10 has a plurality of data lines DL and a plurality of gate lines GL that are crossed to each other. Cross points of the plurality of data lines DL and the plurality of gate lines GL define R, G, and B pixels PR, PG, and PB that are disposed in matrix. The R pixel PR includes an R organic light emitting diode OLED, the G pixel PG includes a G organic light emitting diode OLED, and the B pixel PB includes a B organic light emitting diode OLED. The respective pixels are connected to the data lines DL and the gate lines GL through at least one switching TFT (not shown) to receive data voltages from the data driving circuit 15 and scan pulses from the gate driving circuit 16. Also, the respective pixels are supplied to driving voltage supply lines to receive a high-potential driving voltage Vdd and a low-potential driving voltage Vss from the driving voltage supply circuit 17. The driving voltage supply lines include a high potential driving voltage supply line for applying a high-potential driving voltage Vdd and a low-potential driving voltage supply line for applying a low-potential driving voltage Vss. Especially, at least one of the high-potential driving voltage supply line and the low-potential driving voltage supply line is divided for R, G, and B. The connection structure between the pixels and the driving voltage supply lines will be described later with reference to FIGS. 8*a* to 8*c*. Any well-known pixel structure is applicable to these pixels.

The timing controller 11 re-aligns the digital video data RGB input from the outside in accordance with the resolution of the display panel 10 and supplies the re-aligned data to the data driving circuit 15. Further, the timing controller 11 generates a data control signal DDC for controlling an operation timing of the data driving circuit 15 and a gate control signal GDC for controlling an operation timing of the gate driving circuit 16 on the basis of timing signals such as a vertical synchronization signal Vsync, a horizontal synchronization signal Hsync, a dot clock signal DCLK, and a data enable signal DE.

The current estimating circuit 11*a* estimates driving currents flowing through the R pixels PR, G pixels PG, and B pixels PB for each frame corresponding to input digital video data for one frame. Based on these driving currents, digital estimated current values Iest(R/G/B) for R, G, and B in a corresponding frame are generated. The current estimating circuit 11*a* will be described later with reference to FIG. 9.

The current sensing circuit 12 senses analog driving currents for R, G, and B flowing in the driving voltage supply lines for R, G, and B, and convert these analog driving currents for R, G, and B to generate digital sensing current values Isen(R/G/B) for R, G, and B. The current sensing circuit 12 will be described later with reference to FIG. 10.

The gamma power source control circuit 13 compares the digital estimated current values Iest(R/G/B) for R, G, and B with the digital sensing current values Isen(R/G/B) for R, G, and B to generate digital luminance control values for R, G, and B. By digital-to-analog converting these digital luminance control values for R, G, and B, the output level of the high-potential gamma power sources MVDD (R/G/B) for R, G, and B is controlled to realize constant luminance (desired luminance) regardless of an image display pattern or an outdoor environmental condition. The gamma power source control circuit 13 will be described later with reference to FIG. 11.

The gamma reference voltage generating circuit 14 includes a plurality of resistor strings connected between the high-potential gamma power sources MVDD provided separately for R, G, and B and the ground power source and generates a plurality of gamma reference voltages GMA(R/G/B) for R, G, and B divided between a high-potential voltage and the ground voltage. Here, the amplitude of the gamma reference voltages GMA(R/G/B) for R, G, and B are dependent on the output level of the high-potential gamma power sources MVDD(R/G/B) for R, G, and B. The gamma reference voltage generating circuit 14 will be described with reference to FIG. 12.

The data driving circuit 15 converts the input digital video data RGB into gamma compensation voltages for R, G, and B with reference to the gamma reference voltages GMA(R/G/B) for R, G, and B under control of the data control signal DDC, and supplies the gamma compensation voltages for R, G, and B as data voltages to the data lines DL of the display panel 10.

The gate driving circuit 16 generates a scan pulse which is swung between a gate high voltage for turning on the TFT in a pixel and a gate low voltage for turning off the TFT in response to the gate control signal GDC. Further, the gate driving circuit 16 supplies the scan pulse to the gate lines GL to sequentially drive the gate lines GL, thereby selecting the horizontal line of the display panel 10 to be supplied with a data voltage.

The driving voltage supply circuit 17 generates a high-potential driving voltage Vdd and a low-potential driving voltage Vss, and supplies the high-potential driving voltage Vdd and/or the low-potential driving voltage Vss to the R, G, and B pixels PR, PG, and PB, respectively, through the driving voltage supply lines.

Figure 8A:
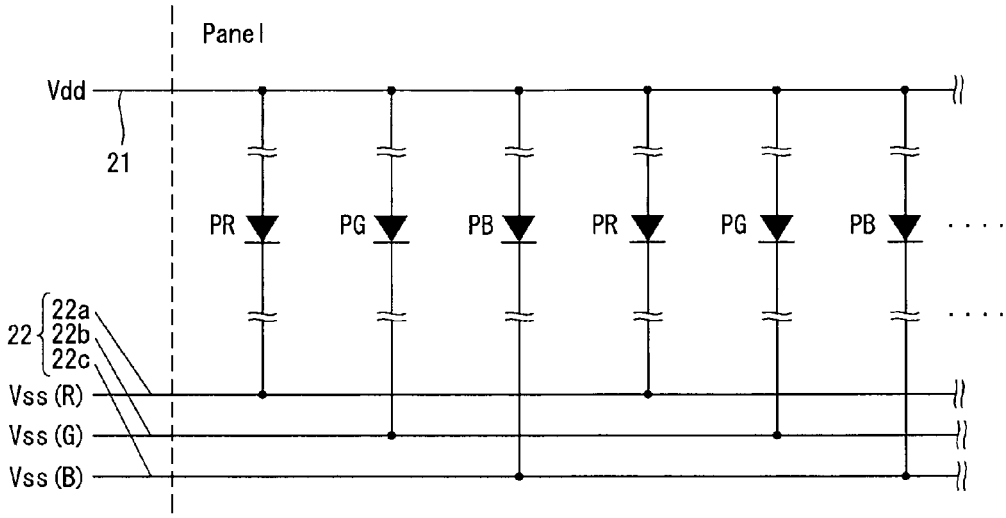
FIGS. 8*a* to 8*c* are views showing a connection structure between pixels and driving voltage supply lines.
Figure 8B:
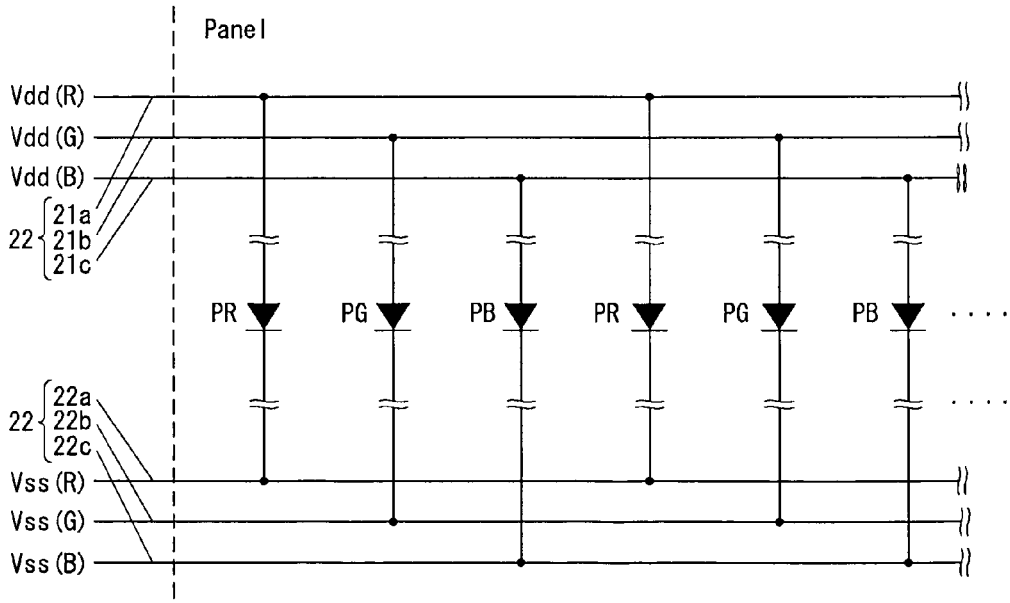
Figure 8C:
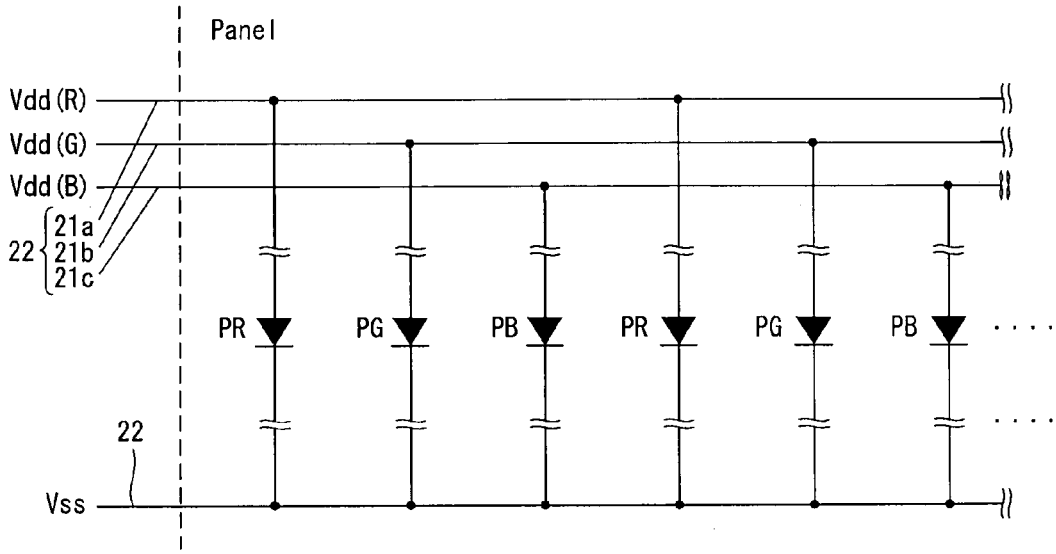

FIGS. 8*a* to 8*c* show a connection structure between the pixels and the driving voltage supply lines.

The driving voltage supply lines include a high-potential driving voltage supply line 21 for applying a high-potential driving voltage Vdd and a low-potential driving voltage supply line 22 for applying a low-potential driving voltage Vss. In accordance with the connection structure between the driving TFT DT and the organic light emitting diode OLED and/or a method of forming a semiconductor layer constituting the driving TFT DT, at least one of the high-potential driving voltage supply line 21 and the low-potential driving voltage supply line 22 is divided for R, G, and B.

Figure 1:
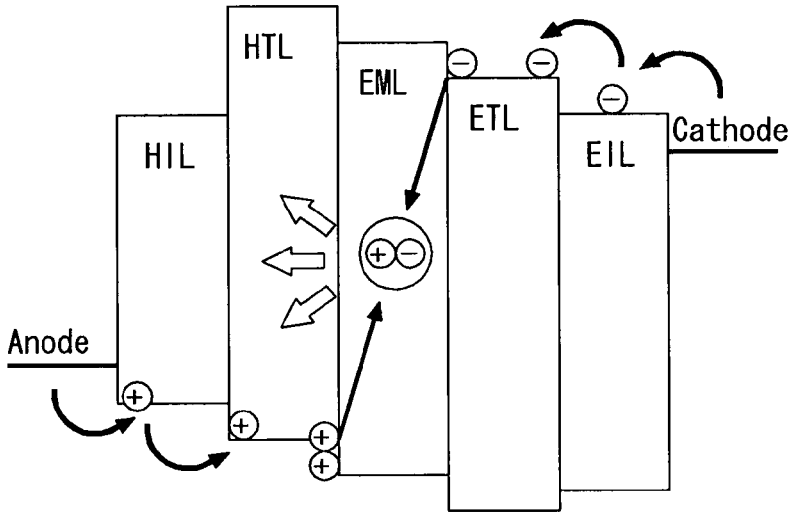
FIG. 1 (Related Art)
FIG. 1 is a diagram for explaining the light emission principle of a general organic light emitting diode display.
Figure 2:
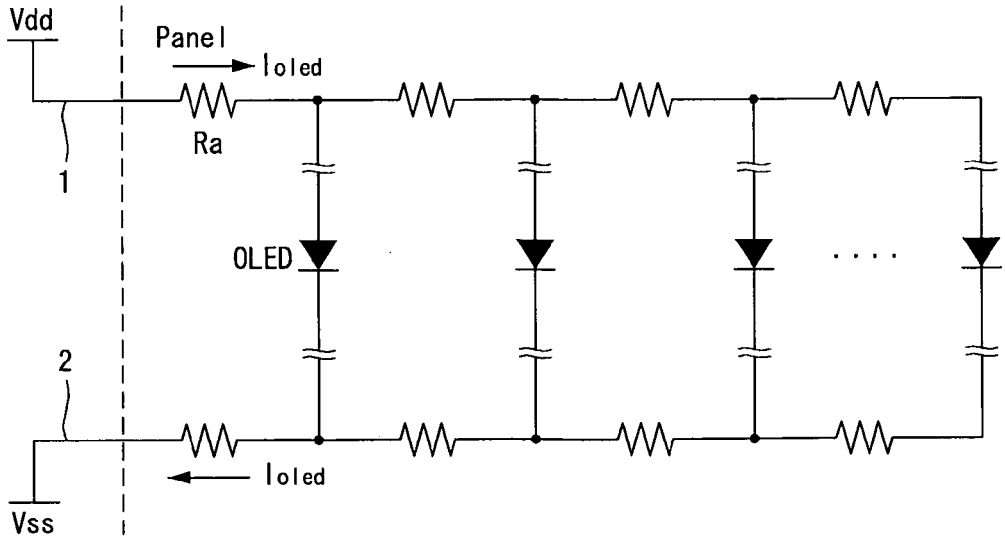
FIG. 2 (Related Art)
FIG. 2 is a view for explaining an IR drop generated in an organic light emitting diode display of a voltage driving type.
Figure 3A:
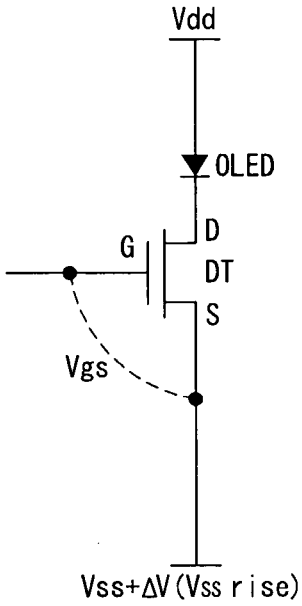
FIG. 3A (Related Art)
FIGS. 3*a* and 3*b* are views showing a variation in the voltage between the gate and source of a driving TFT caused by an IR drop on a panel using an a-Si (amorphous silicon) backplane.
Figure 3B:
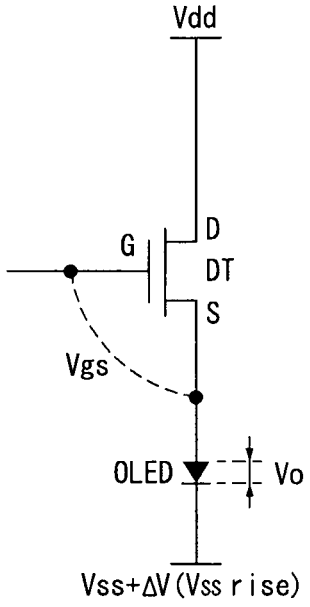
FIG. 3B (Related Art)

For example, as shown in FIG. 3*a*, in case of a pixel structure of an IOD (inverted OLED) type in which the driving TFT DT is constructed as an N type MOSFET (metal-oxide semiconductor field effect transistor) including an a-Si (amorphous silicon) semiconductor layer and the cathode electrode of the organic light emitting diode OLED is in contact with the drain electrode D of the driving TFT DT, and as shown in FIG. 3*b*, in case of a pixel structure of an NOD (normal OLED) type in which the driving TFT DT is constructed as an N type MOSFET including an a-Si semiconductor layer and the anode electrode of the organic light emitting diode OLED is in contact with the source electrode S of the driving TFT DT, the low-potential driving voltage supply line 22 may be divided for R, G, and B as in FIG. 8*a*, or both of the high-potential and low-potential driving voltage supply lines 21 and 22 may be divided for R, G, and B as in FIG. 8*b*. The reason why the low-potential driving voltage supply line 22 has to be divided for R, G, and B is because the low-potential driving voltage supply line 22 is connected to the source electrode S of the driving TFT DT. In other words, in the pixel structures shown in FIGS. 3*a* and 3*b*, a rise ΔV of the potential of the source electrode S of the driving TFT DT according to an image display pattern, i.e., a rise ΔV of the low-potential driving voltage Vss in the pixels differs among the R, G, and B pixels PR, PG, and PB, and accordingly, a difference between R driving currents flowing through the R pixels PR, a difference between G driving currents flowing through the G pixels PG, and a difference between B driving currents flowing through the B pixels PB are different from one another. Here, the difference refers to a difference between a driving current for realizing a desired luminance corresponding to the input digital video data RGB and an actual driving current resulting from the rise of the low-potential driving voltage Vss in the pixels. Further, in the pixel structure shown in FIG. 3*b*, a rise ΔV of the potential of the source electrode S of the driving TFT DT according to an outdoor environmental condition, i.e., a rise ΔV of the low-potential driving voltage Vss in the pixels differs among the R, G, and B pixels PR, PG, and PB, and accordingly, a difference between R driving currents flowing through the R pixels PR, a difference between G driving currents flowing through the G pixels PG, and a difference between B driving currents flowing through the B pixels PB are different from one another.

Figure 4:
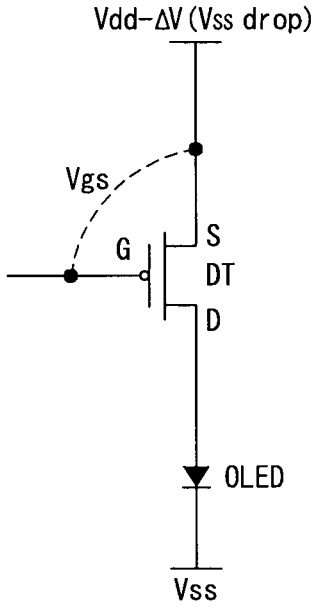
FIG. 4 (Related Art)
FIG. 4 is a view showing a variation in the voltage between the gate and source of a driving TFT caused by an IR drop on a panel using an LTPS (low temperature polysilicon) backplane.
Figure 5:
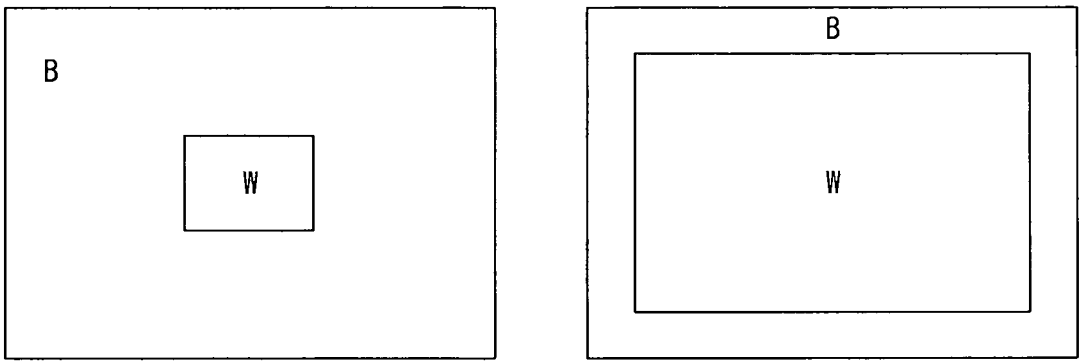
FIG. 5 (Related Art)
FIG. 5 is a view for explaining that a luminance difference between a desired level and an actual luminance level differs according to an image display pattern.
Figure 6:
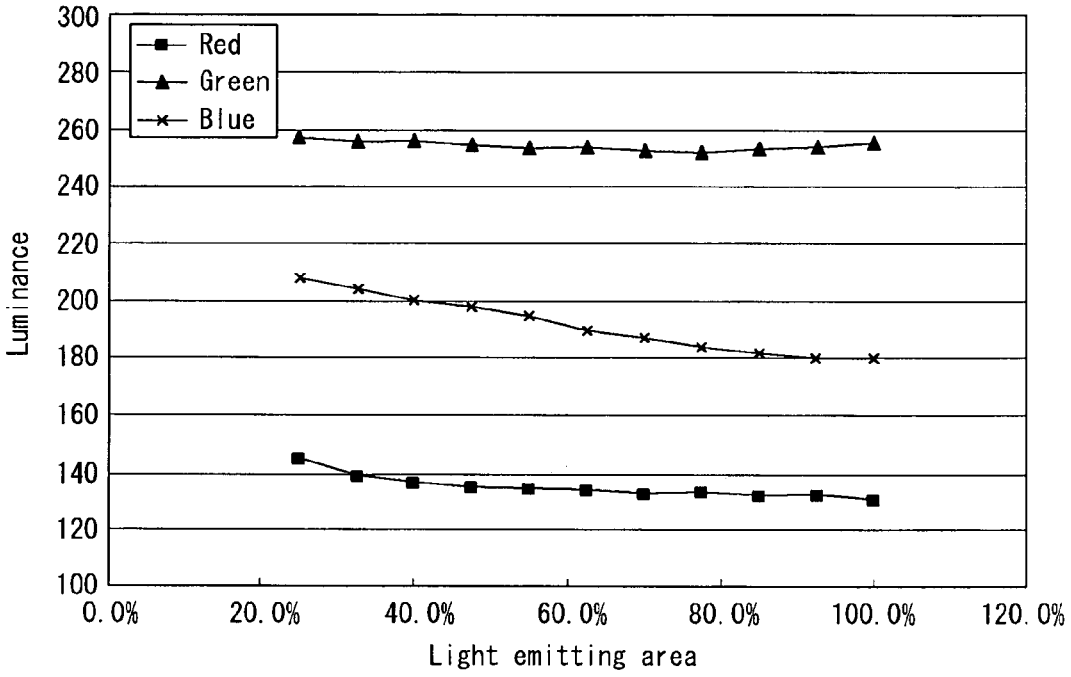
FIG. 6 (Related Art)
FIG. 6 is a graph showing change in luminance according to a light emitting area for each of R, G, and B pixels.

On the other hand, as shown in FIG. 4, in case of a pixel structure in which the driving TFT DT is constructed as a P type MOSFET including an LTPS (low temperature polysilicon) semiconductor layer and the anode electrode of the organic light emitting diode OLED is in contact with the drain electrode D of the driving TFT DT, the high-potential driving voltage supply line 21 may be divided for R, G, and B as in FIG. 8*c*, or both of the high-potential and low-potential driving voltage supply lines 21 and 22 may be divided for R, G, and B as in FIG. 8*d*. The reason why the high-potential driving voltage supply line 21 has to be divided for R, G, and B is because the high-potential driving voltage supply line 21 is connected to the source electrode S of the driving TFT DT. In other words, in the pixel structure shown in FIG. 4, a drop ΔV of the potential of the source electrode S of the driving TFT DT according to an image display pattern, i.e., a drop ΔV of the high-potential driving voltage Vdd in the pixels differs among the R, G, and B pixels PR, PG, and PB, and accordingly, a difference between R driving currents flowing through the R pixels PR, a difference between G driving currents flowing through the G pixels PG, and a difference between B driving currents flowing through the B pixels PB are different from one another. Here, the difference refers to a difference between a driving current for realizing a desired luminance corresponding to the input digital video data RGB and an actual driving current resulting from the drop of the high-potential driving voltage Vdd in the pixels.

Figure 9:
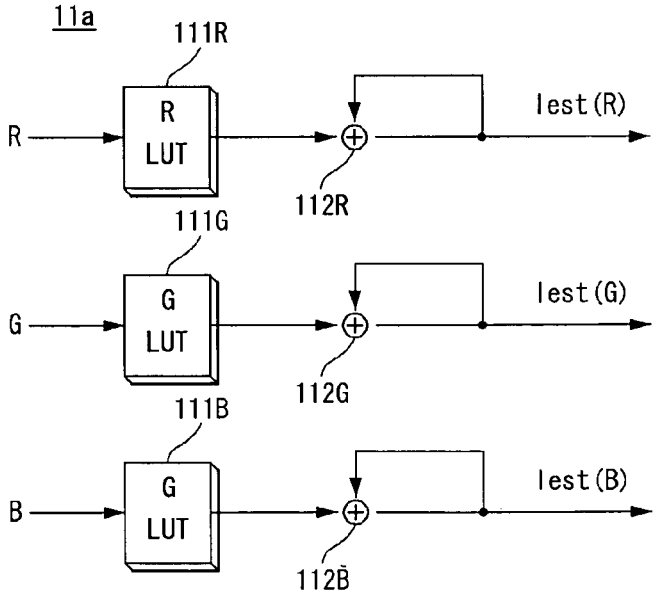
FIG. 9 is a view showing in detail a current estimating circuit.

FIG. 9 shows the current estimating circuit 11*a* in detail.

Referring to FIG. 9, the current estimating circuit 11*a* generates digital estimated current values Iest(R/G/B) for R, G, and B in the corresponding frame through the input digital video data RGB and TFT modeling. To this end, the current estimating circuit 11*a* includes look-up tables 111R, 111G, and 111B and adders 112R, 112G, and 112B which are provided for R, G, and B.

The R look-up table 111R stores R driving current values determined beforehand through an experiment corresponding to respective gray level values of R data, and outputs the corresponding R driving current value upon each receipt of the R data. The R adder 112R adds R driving current values for one frame output from the R look-up table 111R to generate an R digital estimated current value Iest(R) in the corresponding frame.

The G look-up table 111G stores G driving current values determined beforehand through an experiment corresponding to respective gray level values of G data, and outputs the corresponding G driving current value upon each receipt of the G data. The G adder 112G adds G driving current values for one frame output from the G look-up table 111G to generate a G digital estimated current value Iest(G) in the corresponding frame.

The B look-up table 111B stores B driving current values determined beforehand through an experiment corresponding to respective gray level values of B data, and outputs the corresponding R driving current value upon each receipt of the B data. The B adder 112B adds B driving current values for one frame output from the B look-up table 111B to generate a B digital estimated current value Iest(B) in the corresponding frame.

The current estimating circuit 111*a* of this type may be incorporated in the timing controller 11.

Figure 10:
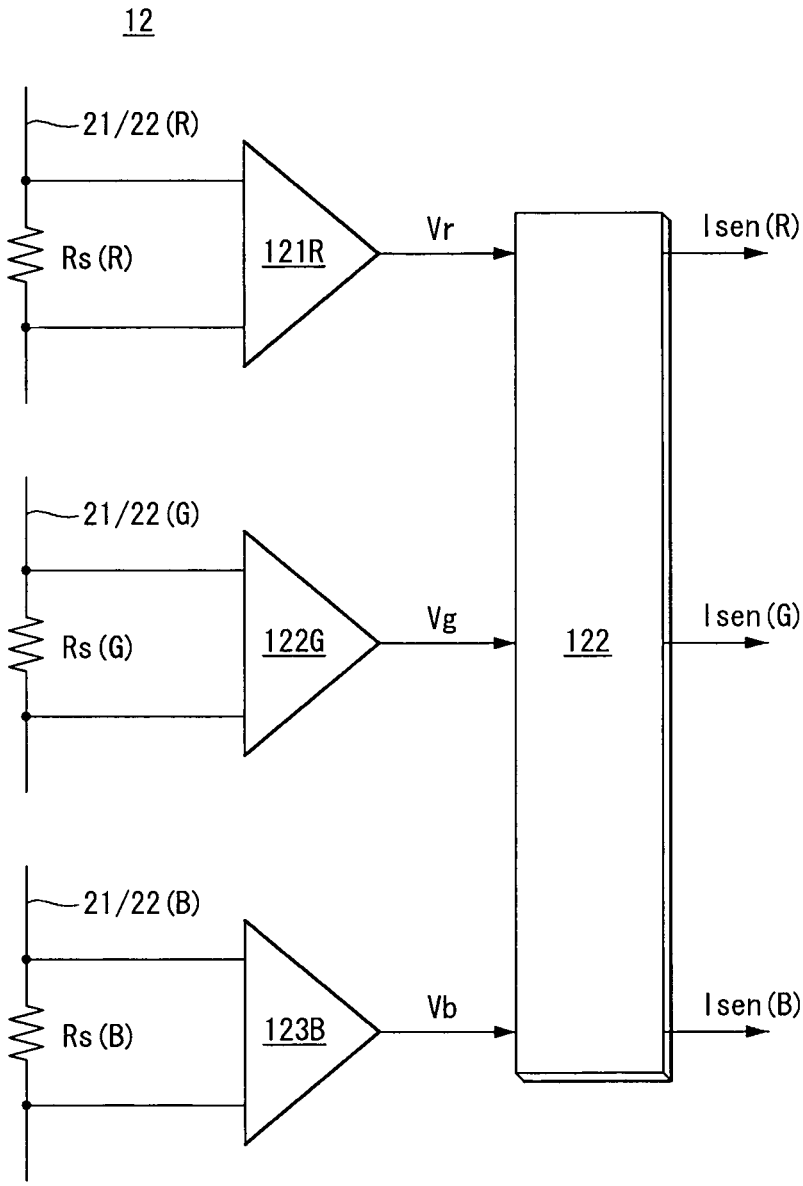
FIG. 10 is a view showing in detail a current sensing circuit.

FIG. 10 shows the current sensing circuit 12 in detail.

Referring to FIG. 10, the current sensing circuit 12 senses analog driving currents for R, G, and B flowing in the driving voltage supply lines for R, G, and B, and analog-to-digital converts the analog driving currents for R, G, and B to generate digital sensing current values Isen(R/G/B). To this end, the current sensing circuit 12 include sensing resistors Rs(R), Rs(G), and Rs(B), amplifiers 121R, 121G, and 12B for R, G, and B, and an analog-to-digital converter (hereinafter, referred to as ADC) 122.

The R sensing resistor Rs(R) may be formed on the low-potential driving voltage supply line 22*a* between the driving voltage supply circuit 17 and the display panel 10 in case of FIGS. 8*a* and 8*b*, or may be formed on the high-potential driving voltage supply line 21*a* between the driving voltage supply circuit 17 and the display panel 10 in case of FIGS. 8*b* and 8*c*. The R amplifier 121R is connected to both terminals of the R sensing resistor Rs(R) to convert the R driving current value flowing in the R sensing resistor Rs(R) in the corresponding frame into a voltage value Vr, amplify the voltage value Vr and then output it.

The G sensing resistor Rs(G) may be formed on the low-potential driving voltage supply line 22*b* between the driving voltage supply circuit 17 and the display panel 10 in case of FIGS. 8*a* and 8*b*, or may be formed on the high-potential driving voltage supply line 21*b* between the driving voltage supply circuit 17 and the display panel 10 in case of FIGS. 8*b* and 8*c*. The G amplifier 121G is connected to both terminals of the G sensing resistor Rs(G) to convert the G driving current value flowing in the G sensing resistor Rs(G) in the corresponding frame into a voltage value Vg, amplify the voltage value Vg and then output it.

The B sensing resistor Rs(B) may be formed on the low-potential driving voltage supply line 22*c* between the driving voltage supply circuit 17 and the display panel 10 in case of FIGS. 8*a* and 8*b*, or may be formed on the high-potential driving voltage supply line 21*c* between the driving voltage supply circuit 17 and the display panel 10 in case of FIGS. 8*b* and 8*c*. The B amplifier 121B is connected to both terminals of the B sensing resistor Rs(B) to convert the B driving current value flowing in the B sensing resistor Rs(B) in the corresponding frame into a voltage value Vb, amplify the voltage value Vb and then output it.

The ADC 122 analog-to-digital converts the voltage value Vr from the R amplifier 121R to generate the R digital sensing current value Isen(R), analog-to-digital converts the voltage value Vg from the G amplifier 121G to generate the G digital sensing current Isen(G), and analog-to-digital converts the voltage value Vb from the B amplifier 121B to generate the B digital sensing current value Isen(B).

Figure 11:
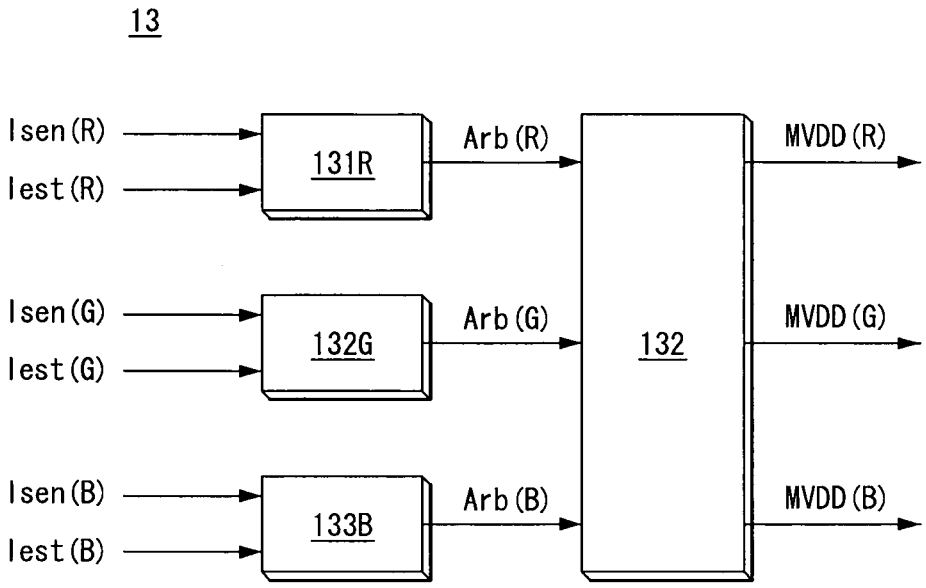
FIG. 11 is a view showing in detail a gamma power source control circuit.

FIG. 11 shows the gamma power control circuit 13 in detail.

Referring to FIG. 11, the gamma power control circuit 13 compares the digital estimated current values Iest(R/G/B) with the digital sensing current values Isen(R/G/B) to generate digital luminance control values Arb(R/G/B) for R, G, and B, and digital-to-analog converts the digital luminance control values Arb(R/G/B) for R, G, and B to control the output level of the high-potential gamma power sources MVDD(R/GB). To this end, the gamma power source control circuit 13 includes comparators 131R, 131G, and 131B for R, G, and B and a digital-to-analog converter (hereinafter, referred to as DAC) 132.

The R comparator 131R compares the R digital estimated current value Iest(R) with the R digital sensing current value Isen(R) to generate the R digital luminance value Isen(R). The R digital luminance control value Arb(R) is generated as a digital value which lowers the output level of the R high-potential gamma power source MVDD(R) so that the R digital sensing current value Isen(R) is equal to the R digital estimated current value Iest(R) in case the R digital sensing current value Isen(R) is larger than the R digital estimated current value Iest(R). On the other hand, the R digital luminance control value Arb(R) is generated as a digital value which raises the output level of the R high-potential gamma power source MVDD(R) so that the R digital sensing current value Isen(R) is equal to the R digital estimated current value Iest(R) in case the R digital sensing current value Isen(R) is smaller than the R digital estimated current value Iest(R).

The G comparator 131G compares the G digital estimated current value Iest(G) with the G digital sensing current value Isen(G) to generate the G digital luminance value Isen(G). The G digital luminance control value Arb(G) is generated as a digital value which lowers the output level of the G high-potential gamma power source MVDD(G) so that the G digital sensing current value Isen(G) is equal to the G digital estimated current value Iest(G) in case the G digital sensing current value Isen(G) is larger than the G digital estimated current value Iest(G). On the other hand, the G digital luminance control value Arb(G) is generated as a digital value which raises the output level of the G high-potential gamma power source MVDD(G) so that the G digital sensing current value Isen(G) is equal to the G digital estimated current value Iest(G) in case the G digital sensing current value Isen(G) is smaller than the G digital estimated current value Iest(G).

The B comparator 131B compares the B digital estimated current value Iest(B) with the B digital sensing current value Isen(B) to generate the B digital luminance value Isen(B). The B digital luminance control value Arb(B) is generated as a digital value which lowers the output level of the B high-potential gamma power source MVDD(B) so that the B digital sensing current value Isen(B) is equal to the B digital estimated current value Iest(B) in case the B digital sensing current value Isen(B) is larger than the B digital estimated current value Iest(B). On the other hand, the B digital luminance control value Arb(B) is generated as a digital value which raises the output level of the B high-potential gamma power source MVDD(B) so that the B digital sensing current value Isen(B) is equal to the B digital estimated current value Iest(B) in case the B digital sensing current value Isen(B) is smaller than the R digital estimated current value Iest(B).

The DAC 132 digital-to-analog converts the R digital luminance control value Arb(R) from the R comparator 131R and outputs the analog value to the R high-potential gamma power source MVDD(R), digital-to-analog converts the G digital luminance control value Arb(G) from the G comparator 131G and outputs the analog value to the G high-potential gamma power source MVDD(G), and digital-to-analog converts the B digital luminance control value Arb(B) from the B comparator 131B and outputs the analog value to the B high-potential gamma power source MVDD(B)

Figure 12:
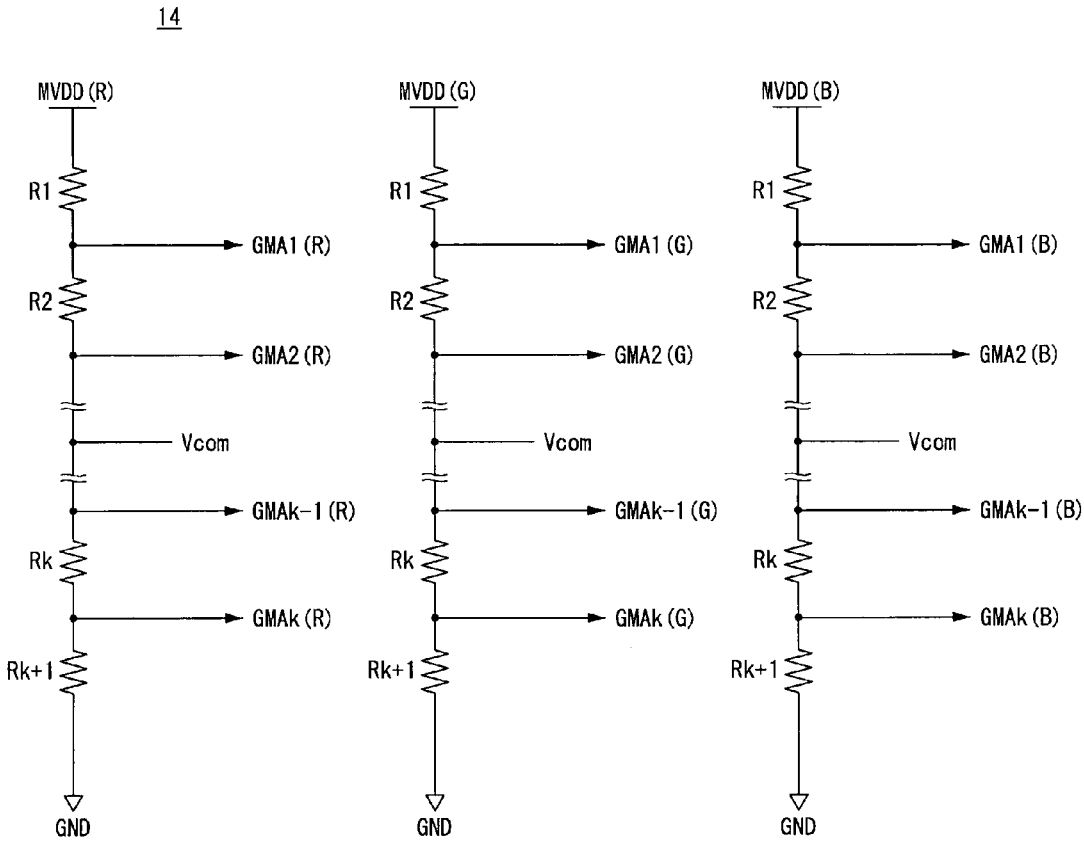
FIG. 12 is a view showing in detail a gamma reference voltage generating circuit.

FIG. 12 shows the gamma reference voltage generating circuit 14 in detail.

Referring to FIG. 12, the gamma reference voltage generating circuit 14 include an R resistor string connected between the R high-potential gamma power source MVDD (R) and the ground power source GND, a G resistor string connected between the G high-potential gamma power source MVDD(G) and the ground power source GND, and a B resistor string connected between the B high-potential gamma power source MVDD(B) and the ground power source GND. The R resistor string includes a plurality of resistors R1 to Rk+1 for dividing the R high-potential gamma power source MVDD(R) to generate R gamma reference voltages GMA1(R) to GMAk(R), the G resistor string includes a plurality of resistors R1 to Rk+1 for dividing the G high-potential gamma power source MVDD(G) to generate G gamma reference voltages GMA1(G) to GMAk(G), and the B resistor string includes a plurality of resistors R1 to Rk+1 for dividing the B high-potential gamma power source MVDD(B) to generate B gamma reference voltages GMA1 (B) to GMAk(B). Accordingly, the level of the gamma reference voltages for R, G, and B can be easily controlled to a desired value by controlling the level of the high-potential gamma power sources MVDD(R/G/B) for R, G, and B.

As described above, the organic light emitting diode display and driving method thereof according to the present invention can control high-potential gamma power sources for R, G, and B to make estimated driving currents flow in R, G, and B pixels by dividing, for R, G, and B, a high-potential driving voltage line and/or a low-potential driving voltage supply line for supplying driving voltages to pixels of a display panel and comparing sensing driving currents for R, G, and B fed back through the divided driving voltage supply lines with estimated driving currents for R, G, and B predicted through input digital video data. Consequently, the organic light emitting diode display and driving method thereof according to the present invention can realize desired luminance (constant luminance) suitable for a corresponding image display pattern without any effect from an outdoor environment condition and effectively prevent color distortion caused by difference in luminance between R, G, and B.

It will be understood by those skilled in the art that various changes and modifications may be applicable within a range not departing from the technical idea of the invention. Accordingly, the technical scope of the present invention is not limited to the detailed description of the specification, but should be defined by the accompanying claims.

What is claimed is:

1. An organic light emitting diode display, comprising:

a display panel where a plurality of R, G, and B pixels are formed at crossing points of a plurality of data lines and a plurality of gate lines and at least one of a high-potential driving voltage supply line and a low-potential driving voltage supply line is disposed divided for R, G, and B;

a data driving circuit for converting input RGB data into data voltages with reference to gamma reference voltages and then supplying the data voltages to the data lines;

a gamma reference voltage generating circuit for generating the gamma reference voltages for R, G, and B by dividing voltages of high-potential gamma power sources for R, G, and B;

a current estimating circuit for generating digital estimated current values for R, G, and B in a corresponding frame by using the input RGB data for one frame;

a current sensing circuit for generating digital sensing current values for R, G, and B in the corresponding frame by using driving currents for R, G, and B fed back from the divided driving voltage supply lines; and a gamma power source control circuit for generating digital luminance control values for R, G, and B by comparing the digital estimated current values for R, G, and B with the digital sensing current values for R, G, and B, and controlling the output level of the high-potential gamma power sources for R, G, and B by digital-to-analog converting the digital luminance control values for R, G, and B, wherein the gamma power source control circuit includes an R comparator for comparing an R digital estimated current value with an R digital sensing value to generate an R digital luminance control value, and wherein the R digital luminance control value is generated as a digital value which lowers the output level of the R high-potential gamma power source in case the R digital sensing current value is larger than the R digital estimated current value, or the R digital luminance control value is generated as a digital value which raises the output level of the R high-potential gamma power source in case the R digital sensing current value is smaller than the R digital estimated current value.

2. The organic light emitting diode display of claim 1, wherein the current estimating circuit further comprises:

an R adder for accumulating corresponding R driving current values output upon each receipt of the R data and generating an R digital estimated current value in the corresponding frame;

a G adder for accumulating corresponding G driving current values output upon each receipt of the G data and generating a G digital estimated current value in the corresponding frame; and a B adder for accumulating corresponding B driving current values output upon each receipt of the B data and generating a B digital estimated current value in the corresponding frame.

3. The organic light emitting diode display of claim 1, wherein the current sensing circuit comprises:

an R amplifier for converting a R driving current value flowing in a R sensing resistor in the corresponding frame into a voltage value and outputting the same;

a G amplifier for converting a G driving current value flowing in a G sensing resistor in the corresponding frame into a voltage value and outputting the same;

a B amplifier for converting a B driving current value flowing in a B sensing resistor in the corresponding frame into a voltage value and outputting the same; and an analog-to-digital converter for analog-to-digital converting the voltage values from the R, G, and B amplifiers and generating digital sensing current values for R, G, and B.

4. The organic light emitting diode display of claim 3, wherein the organic light emitting diode display further comprises a driving voltage supply circuit for supplying a high-potential driving voltage to the high-potential driving voltage supply line and a low-potential driving voltage to the low-potential driving voltage supply line, and the R, G, and B sensing resistors are formed in the high-potential driving voltage supply line between the driving voltage supply circuit and the display panel or in the low-potential driving voltage supply line between the driving voltage supply circuit and the display panel.

5. The organic light emitting diode display of claim 1, wherein the gamma power source control circuit further includes:

a G comparator for comparing a G digital estimated current value with a G digital sensing value to generate a G digital luminance control value;

a B comparator for comparing a B digital estimated current value with a B digital sensing value to generate a B digital luminance control value; and a digital-to-analog converter for digital-to-analog converting the R, G, and B digital luminance control values and outputting the analog values as the high-potential gamma power sources for R, G, and B, respectively.

6. The organic light emitting diode display of claim 5, wherein the G digital luminance control value is generated as a digital value which lowers the output level of the G high-potential gamma power source in case the G digital sensing current value is larger than the G digital estimated current value, or the G digital luminance control value is generated as a digital value which raises the output level of the G high-potential gamma power source in case the G digital sensing current value is smaller than the G digital estimated current value.

7. The organic light emitting diode display of claim 5, wherein the B digital luminance control value is generated as a digital value which lowers the output level of the B high-potential gamma power source in case the B digital sensing current value is larger than the B digital estimated current value, or the B digital luminance control value is generated as a digital value which raises the output level of the B high-potential gamma power source in case the B digital sensing current value is smaller than the B digital estimated current value.

8. The organic light emitting diode display of claim 1, the organic light emitting diode display further comprises:

a gate driving circuit for supplying a scan pulse to the gate lines; and a timing controller for controlling operation timings of the data driving circuit and gate driving circuit, and the current estimating circuit is incorporated in the timing controller.

9. A driving method of an organic light emitting diode display, comprising a display panel where a plurality of R, G, and B pixels are formed at crossing points of a plurality of data lines and a plurality of gate lines and at least one of a high-potential driving voltage supply line and a low-potential driving voltage supply line is disposed divided for R, G, and B, the method comprising:

generating digital estimated current values for R, G, and B in a corresponding frame by using input RGB data for one frame;

generating digital sensing current values for R, G, and B in the corresponding frame by using driving currents for R, G, and B fed back from the divided driving voltage supply lines;

controlling the high-potential gamma power sources for R, G, and B by comparing the digital estimated current values for R, G, and B with the digital sensing current values for R, G, and B so that driving currents corresponding to the respective digital estimated current values flow in the respective R, G, and B pixels;

generating digital luminance control values for R, G, and B by comparing the digital estimated current values for R, G, and B with the digital sensing current values for R, G, and B, and controlling the output level of the high-potential gamma power sources for R, G, and B by digital-to-analog converting the digital luminance control values for R, G, and B;

dividing the high-potential gamma power sources for R, G, and B to generate gamma reference voltages for R, G, and B; and converting the input RGB data into data voltages with reference to gamma reference voltages and then supplying the data voltages to the data lines, wherein generating digital luminance control values for R, G, and B generates an R digital luminance control value for comparing an R digital estimated current value with an R digital sensing value, and wherein the R digital luminance control value is generated as a digital value which lowers the output level of the R high-potential gamma power source in case the R digital sensing current value is larger than the R digital estimated current value, or the R digital luminance control value is generated as a digital value which raises the output level of the R high-potential gamma power source in case the R digital sensing current value is smaller than the R digital estimated current value.

10. The organic light emitting diode display of claim 1, wherein the current estimating circuit comprises:

an R look-up table for storing a plurality of R driving current values determined beforehand corresponding to gray level values of the R data;

a G look-up table for storing a plurality of G driving current values determined beforehand corresponding to gray level values of the G data; and a B look-up table for storing a plurality of B driving current values determined beforehand corresponding to gray level values of the B data.

* * * * *